US008521347B2

(12) United States Patent
Ito et al.

(10) Patent No.: US 8,521,347 B2
(45) Date of Patent: Aug. 27, 2013

(54) MARINE VESSEL STEERING APPARATUS AND MARINE VESSEL INCLUDING THE SAME

(75) Inventors: Makoto Ito, Shizuoka (JP); Toshiya Inai, Shizuoka (JP); Makoto Mizutani, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 604 days.

(21) Appl. No.: 12/730,420

(22) Filed: Mar. 24, 2010

(65) Prior Publication Data

US 2010/0250035 A1 Sep. 30, 2010

(30) Foreign Application Priority Data

Mar. 31, 2009 (JP) ..... 2009-086404

(51) Int. Cl.
*B63H 25/00* (2006.01)

(52) U.S. Cl.
USPC ..... 701/21; 440/1

(58) Field of Classification Search
USPC ..... 701/21; 318/588; 440/63.6, 1, 41, 440/42, 53, 84, 2, 86; 192/84.7, 90; 114/144 R, 114/144 RE; 74/493, 471 R, 473.3
See application file for complete search history.

(56) References Cited

U.S. PATENT DOCUMENTS

| | | | | |
|---|---|---|---|---|
| 7,354,325 | B2 * | 4/2008 | Mizuguchi et al. | 440/75 |
| 2006/0180070 | A1 * | 8/2006 | Mizutani | 114/144 RE |
| 2006/0217012 | A1 * | 9/2006 | Mizutani | 440/61 S |
| 2007/0066154 | A1 * | 3/2007 | Mizutani | 440/1 |
| 2007/0105463 | A1 * | 5/2007 | Mizutani | 440/61 S |
| 2008/0254689 | A1 * | 10/2008 | Kaji | 440/1 |
| 2008/0261469 | A1 | 10/2008 | Mizuguchi et al. | |
| 2009/0084299 | A1 * | 4/2009 | Mizutani | 114/144 RE |
| 2009/0111339 | A1 * | 4/2009 | Suzuki | 440/1 |

FOREIGN PATENT DOCUMENTS

| | | | |
|---|---|---|---|
| JP | 2006-219002 | A | 8/2006 |
| JP | 2006-321422 | A | 11/2006 |
| JP | 2007-203840 | A | 8/2007 |
| JP | 2007-203842 | A | 8/2007 |
| JP | 2007203840 | * | 8/2007 |

* cited by examiner

*Primary Examiner* — Thomas Black
*Assistant Examiner* — Marthe Marc-Coleman
(74) *Attorney, Agent, or Firm* — Keating & Bennett, LLP

(57) ABSTRACT

A marine vessel steering apparatus includes a steering mechanism arranged to be operable by an operator, a steering unit arranged to turn a pivoting unit mounted pivotally on a marine vessel, a detecting unit arranged to detect if an actual pivoting angle, the turning angle of the pivoting unit, becomes equal to or greater than a predetermined angle, a locking unit arranged to lock the turning of the steering mechanism, and a control unit. The control unit is programmed to set a target pivoting angle based on the turning state of the steering mechanism and to drive the steering unit to make the actual pivoting angle equal to the target pivoting angle. The control unit is also programmed, when the detecting unit detects that the actual pivoting angle becomes equal to or greater than the predetermined angle, to drive the locking unit to lock the turning of the steering mechanism.

13 Claims, 9 Drawing Sheets

MARINE VESSEL STEERING APPARATUS AND MARINE VESSEL INCLUDING THE SAME

BACKGROUND OF THE INVENTION

1. Field of the Invention

The present invention relates to a marine vessel steering apparatus and a marine vessel including the same. The marine vessel steering apparatus is arranged to turn a pivoting unit through a steering unit which is controlled according to the operation of a steering mechanism, such as a steering wheel. The pivoting unit is arranged to be mounted pivotally on a hull. One example of the pivoting unit is an outboard motor with a built-in propulsion unit.

2. Description of Related Art

Japanese Published Unexamined Patent Application No. 2007-203840 discloses a marine vessel steering apparatus according to a related art. In this related art, the turning angle of a steering wheel is detected by a sensor and, based on the detection result, a steering motor (steering unit) is driven, which causes an outboard motor (pivoting unit) to be turned. This is a so-called SBW system (steer-by-wire system). The system according to the related art includes a reactive motor arranged to apply a reactive force to the steering wheel. When the steering wheel is turned in one direction, the turning angle of the steering wheel will reach a stopper angle (limit angle) in due course. In response to this, the reactive motor will apply a torque in the direction opposite to that of the turning of the steering wheel (in which the pivoting unit is returned). This will cause the turning of the steering wheel to be locked. When the turning of the steering wheel is locked, the marine vessel maneuvering operator can recognize that the outboard motor has been turned to the limit angle.

SUMMARY OF THE INVENTION

The inventors of preferred embodiments of the present invention described and claimed in the present application conducted an extensive study and research regarding a marine vessel steering apparatus, such as the one described above, and in doing so, discovered and first recognized new unique challenges and previously unrecognized possibilities for improvements as described in greater detail below.

That is, in the foregoing marine vessel steering apparatus, there can occur a delay in the turning of the outboard motor with respect to the turning of the steering mechanism. That is, a target pivoting angle is set based on a detection result of the turning angle of the steering mechanism from the sensor, and then the steering unit (steering motor) is driven to make the actual pivoting angle of the outboard motor equal to the target pivoting angle, which causes the outboard motor to be turned. In this case, due to a delay in response of the steering unit, there can occur a delay in the turning of the outboard motor with respect to the turning of the steering mechanism. Therefore, even when the steering mechanism may be turned in one direction and the turning angle of the steering mechanism may reach the limit angle, the turning angle of the outboard motor may not reach the limit angle. If the steering mechanism is locked at the time the turning angle of the steering mechanism reaches the limit angle, the turning angle of the outboard motor may reach the limit angle after the steering mechanism is locked. However, it maybe mistakenly believed that the turning angle of the outboard motor has reached the limit angle at the time the steering mechanism is locked. If the steering mechanism is started to be returned back from what is believed to be the limit angle, immediately after the steering mechanism is locked, the pivoting unit will also be returned even though the turning angle of the outboard motor has not reached the limit angle. In this case, the pivoting unit is operated without the turning angle of the outboard motor reaching the limit angle, resulting in less than optimal turning performance of the marine vessel. In particular, there may be a case where the pivoting angle ratio (the ratio of the amount of change in the turning angle of the outboard motor to the amount of change in the turning angle of the steering mechanism) is increased when, for example, launching from and docking on shore. In this case, due to a greater delay in response of the steering unit, the above-described situation becomes more critical.

In order to overcome the previously unrecognized and unsolved challenges described above, a preferred embodiment of the present invention provides a marine vessel steering apparatus including a steering mechanism arranged to be rotatably operable by an operator, a steering unit arranged to turn a pivoting unit to be mounted pivotally on a marine vessel, a first detecting unit arranged to detect if an actual pivoting angle, the turning angle of the pivoting unit, becomes equal to or greater than a predetermined angle, a locking unit arranged to lock the turning of the steering mechanism, and a control unit programmed to control the steering unit and the locking unit. The control unit is programmed to set a target pivoting angle based on the turning state of the steering mechanism and drive the steering unit to make the actual pivoting angle equal to the target pivoting angle and, when the first detecting unit detects that the actual pivoting angle becomes equal to or greater than the predetermined angle, to drive the locking unit to lock the turning of the steering mechanism. The turning state of the steering mechanism may be the turning angle (operating angle) of the steering mechanism or the amount of change in the turning angle of the steering mechanism.

In accordance with the arrangement above, even if there may occur a delay in the turning (steering) of the pivoting unit with respect to the turning (operating) of the steering mechanism, the steering mechanism is locked at the time when the turning angle (pivoting angle) of the pivoting unit becomes equal to or greater than a predetermined angle. This allows the operator to correctly recognize that the pivoting angle is equal to or greater than the predetermined angle because the steering mechanism is locked. This also allows the operator to turn the pivoting unit reliably to the predetermined angle for marine vessel maneuvering, which can prevent the turning performance of the marine vessel from being reduced. Thus, in the marine vessel steering apparatus in which the pivoting unit is arranged to be turned by the steering unit, the steering mechanism can be locked while preventing the turning performance of the marine vessel from being reduced.

As an end result, the locking of the steering mechanism is completely independent of the steering mechanism angle (operating angle) and the target pivoting angle. Hence, the control unit is preferably arranged to control the locking unit so as not to lock the turning of the steering mechanism irrespective of the steering mechanism angle (operating angle) or the target pivoting angle until it is detected that the actual pivoting angle becomes equal to or greater than the predetermined angle. This arrangement can reliably prevent the steering mechanism from being locked before the pivoting angle of the pivoting unit has reached the predetermined angle even when the target pivoting angle may reach the predetermined angle.

Due to a delay in response of the steering unit, there may be a case where the target pivoting angle becomes equal to or greater than the predetermined angle before the actual pivoting angle becomes equal to or greater than the predetermined angle. In this case, the control unit is preferably arranged, when the steering mechanism is turned in the forward steering direction, to keep the target pivoting angle at the predetermined angle. Also, in the case above, the control unit is preferably arranged, when the steering mechanism is turned in the return steering direction, to change the target pivoting angle from the predetermined angle correspondingly to the turning of the steering mechanism in the return steering direction. With this arrangement, in the case where the steering mechanism has been turned farther than the operating angle that corresponds to the predetermined angle, even when the operator may turn the steering mechanism in the return steering direction, the pivoting angle can be returned toward the neutral position according to the operation of the steering mechanism after the steering mechanism starts to be returned. This can prevent a delay in response of the pivoting unit with respect to the operation of the steering mechanism when the pivoting unit starts to be returned.

The "forward steering direction" is an operational direction that corresponds to a steering direction in which the pivoting unit is turned away from the neutral position. The "return steering direction" is an operational direction that corresponds to a steering direction in which the pivoting unit is turned toward the neutral position.

In the case where the target pivoting angle becomes equal to or greater than the predetermined angle before the actual pivoting angle becomes equal to or greater than the predetermined angle, the control unit is preferably arranged, when the steering mechanism is turned in the return steering direction, to replace the target pivoting angle with a return steering start angle, the actual pivoting angle at the time the steering mechanism starts to be turned in the return steering direction. The control unit is programmed to then preferably change the target pivoting angle from the return steering start angle correspondingly to the turning of the steering mechanism in the return steering direction. With this arrangement, even in the case where the steering mechanism has been turned further than the angle that corresponds to the predetermined angle, when the operator turns the steering mechanism in the return steering direction, the pivoting unit follows the operation. That is, the pivoting unit can be returned according to the operation of the steering mechanism after the steering mechanism starts to be returned. This can prevent a delay in response of the pivoting unit with respect to the operation of the steering mechanism when the pivoting unit starts to be returned. Also, even in the case where the steering mechanism has been turned slightly and the target pivoting angle has not reached the predetermined angle, when the operator turns the steering mechanism in the return steering direction, the pivoting unit can be returned according to the operation of the steering mechanism after the steering mechanism starts to be returned.

The locking unit is preferably arranged to lock the turning of the steering mechanism by applying a resistance against the left and right turning of the steering mechanism. The marine vessel steering apparatus preferably further includes a second detecting unit arranged, when the actual pivoting angle becomes equal to or greater than the predetermined angle, to detect if the steering mechanism is turned in the return steering direction or the steering mechanism is about to be turned in the return steering direction. With this arrangement, when the turning of the steering mechanism both in the forward steering direction and the return steering direction is locked by the locking unit, the second detecting unit can detect that the steering mechanism is about to be turned in the return steering direction. Therefore, the steering mechanism locked by the locking unit can be unlocked based on detection information from the second detecting unit.

In the case above, the control unit is preferably programmed to unlock the turning of the steering mechanism locked by the locking unit based on detection information from the second detecting unit. With this arrangement, when the operator turns the steering mechanism in the return steering direction, the steering mechanism locked by the locking unit can be unlocked automatically at the time detected by the second detecting unit. Therefore, even in the case of a locking unit that cannot lock the steering mechanism in a specified turning direction, there is no possibility that the steering mechanism cannot be returned (turned in the return steering direction) after being locked. In addition, the locking of the steering mechanism is controlled according to the actual pivoting angle, while the unlocking of the steering mechanism is controlled according to the operation of the steering mechanism. This allows the operator to operate the steering mechanism until the actual pivoting angle reaches the predetermined angle as well as to unlock and steer the steering mechanism according to his/her own intentions. That is, the operator is prevented from making the mistake of erroneously believing that the pivoting unit has been turned to its maximum pivoting angle before the actual pivoting angle reaches the maximum pivoting angle, whereby the pivoting unit can be turned reliably to its maximum pivoting angle. At the same time, the steering mechanism can be unlocked appropriately according to the operator's own intentions.

The locking unit preferably includes magnetic fluid and a magnetic field generating portion and is arranged to apply resistance against the left and right turning of the steering mechanism when the magnetic field generating portion is applied with a current to change the viscosity of the magnetic fluid. This arrangement allows the structure of the locking unit to be simplified and the power consumption when locking the steering mechanism to be reduced.

The first detecting unit preferably includes a pivoting angle sensor arranged to detect the actual pivoting angle of the pivoting unit as an absolute angle, and the marine vessel steering apparatus preferably further includes a steering mechanism angle detecting unit arranged to detect the amount of change in the turning angle (relative angle) of the steering mechanism. With this arrangement, even in the case where it is difficult to recognize the absolute turning angle (operating angle) of the steering mechanism due to the use of a steering mechanism angle detecting unit arranged to detect a relative angle, the steering mechanism can be locked appropriately. That is, since the pivoting angle sensor can detect the absolute turning angle (actual pivoting angle) of the pivoting unit, the steering mechanism can be locked at the appropriate time based on detection information from the pivoting angle sensor.

The pivoting unit is preferably an outboard motor arranged to be mounted on a hull pivotally within a predetermined angular range in response to the turning of the steering mechanism. With this arrangement, the steering mechanism is locked at the time the turning angle (actual pivoting angle) of the outboard motor becomes equal to or greater than the predetermined angle. This allows the operator to correctly recognize that the actual pivoting angle of the outboard motor is equal to or greater than the predetermined angle because the steering mechanism is locked. This also allows the operator to turn the outboard motor reliably to the predetermined angle, which can prevent the turning performance of the marine vessel from being reduced.

A preferred embodiment of the present invention provides a marine vessel including a hull, a pivoting unit mounted pivotally on the hull, and a marine vessel steering apparatus having the above-described features. This allows the pivoting unit to be turned reliably to its maximum pivoting angle, providing a marine vessel having an excellent maneuvering performance (particularly turning performance).

Other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
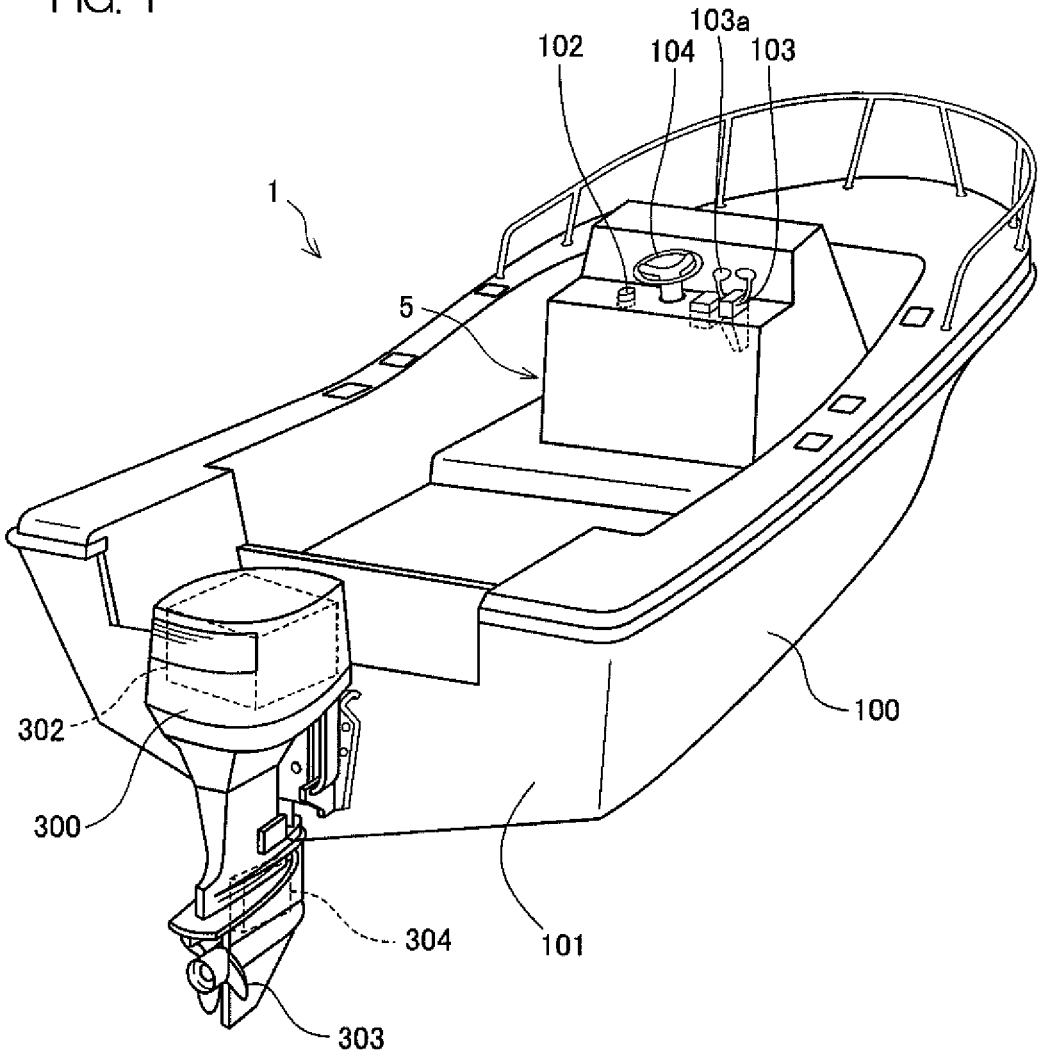
FIG. 1 is a perspective view of a marine vessel including a marine vessel steering apparatus according to a first preferred embodiment of the present invention.

The configuration of a marine vessel including a marine vessel steering apparatus according to a first preferred embodiment of the present invention will hereinafter be described with reference to FIGS. 1 to 4.

The marine vessel 1 according to the first preferred embodiment includes a hull 100, a steering unit 200, and an outboard motor 300. The outboard motor 300 is mounted at the stern 101 of the hull 100 via the steering unit 200. The hull 100 includes a marine vessel maneuvering station 5 provided, for example, at the front portion thereof. The marine vessel maneuvering station 5 includes a main switch 102, a remote control lever unit 103, a steering mechanism 104, and the like arranged thereon.

The main switch 102 is arranged to be operated by a marine vessel maneuvering operator to switch between power-on and -off of a marine vessel propulsion system. The marine vessel propulsion system includes the steering mechanism 104, steering unit 200, outboard motor 300, and a control unit therefor, corresponding to a marine vessel steering apparatus according to a preferred embodiment of the present invention. The remote control lever unit 103 is arranged to be operated by the operator for direction of throttle opening degree and shift switching. The steering mechanism (e.g., steering wheel) 104 is arranged to be operated (e.g., rotated or turned) by the operator to change the heading direction of the hull 100. The remote control lever unit 103 includes an operation lever 103*a* arranged to be back-and-forth rotatably operated by the operator. With the turning of the operation lever 103*a*, the shift of the outboard motor 300 can be switched among neutral, forward, and reverse. Further, with the turning of the operation lever 103*a*, acceleration control can be performed (throttle opening degree can be changed) for an engine 302 included in the outboard motor 300.

The steering mechanism 104 is operated by the operator for steering of the marine vessel 1. The steering mechanism 104 is arranged to be turnable any number of times when the marine vessel propulsion system is powered off.

Figure 4:
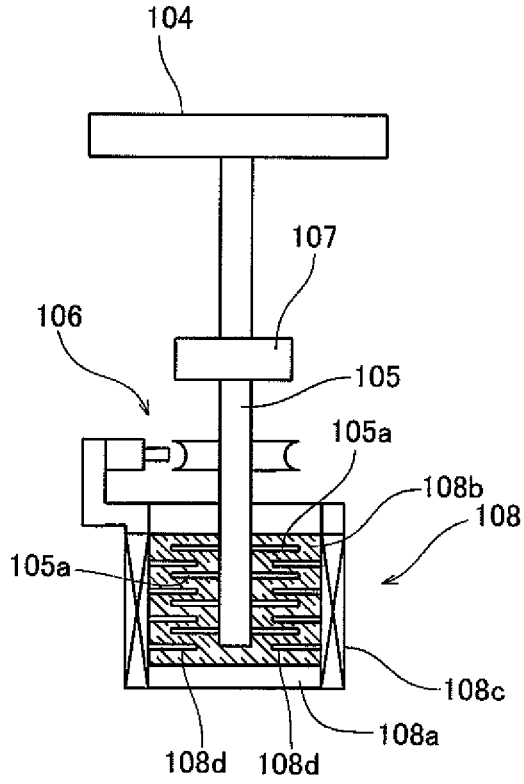
FIG. 4 is a schematic view showing the structure of a locking mechanism for a steering mechanism in the marine vessel steering apparatus.

As shown in FIG. 4, the steering mechanism 104 is provided with a steering mechanism shaft 105 coupled to the steering mechanism 104 to be turnable integrally with the steering mechanism 104. The shaft 105 is provided with a steering mechanism angle sensor 106 arranged to detect the turning angle (operating angle) of the steering mechanism 104 (i.e., the rotation angle of the shaft 105) and a torque sensor 107 arranged to detect torque about the shaft 105. The steering mechanism angle sensor 106 is arranged to be capable of detecting the turning angle of the steering mechanism 104 (the rotation angle of the steering mechanism shaft 105) as a relative angle with respect to a given reference position. That is, the steering mechanism angle sensor 106 has no fixed reference point (zero-degree position) and is arranged to detect a relative angle with respect to a variable reference point (to be reset every time the system is powered on). The torque sensor 107 is arranged to detect torque about the shaft 105. The torque sensor 107 can thus detect if the steering mechanism 104 is about to be turned in the forward steering direction or the steering mechanism 104 is about to be turned in the return steering direction. The torque sensor 107 is an example of a "second detecting unit" according to a preferred embodiment of the present invention.

Also, the steering mechanism 104 is preferably provided with a locking mechanism 108 to be controlled to lock the turning of the steering mechanism 104. As shown in FIG. 4, the locking mechanism 108 includes a magnetic fluid holder 108*a* fixed to the hull 100, magnetic fluid 108*b* filled in the magnetic fluid holder 108*a*, and a coil 108*c* wound around the magnetic fluid 108*b*. The lower end portion of the steering mechanism shaft 105 is inserted in the magnetic fluid holder 108*a*. The magnetic fluid 108*b* has a property that the viscosity thereof varies depending on the magnitude of a magnetic field. The locking mechanism 108 is arranged to change the viscosity of the magnetic fluid 108*b* by energizing the coil 108*c*, and thereby to apply a resistance against the motion of the shaft 105. Also, plates 108*d* and 105*a* are fixed, respectively, to the magnetic fluid holder 108*a* and the shaft 105. These plates 108*d* and 105*a* make it possible to apply a resistance by the magnetic fluid 108*b* effectively to the shaft 105. The locking mechanism 108 is an example of a "locking unit" according to a preferred embodiment of the present invention. The coil 108*c* is an example of a "magnetic field generating portion" according to a preferred embodiment of the present invention.

The locking mechanism 108 may be arranged with a use of TFD® Steer-By-Wire Device supplied by LORD Corporation under a reference No. RD-2069-01.

Figure 2:
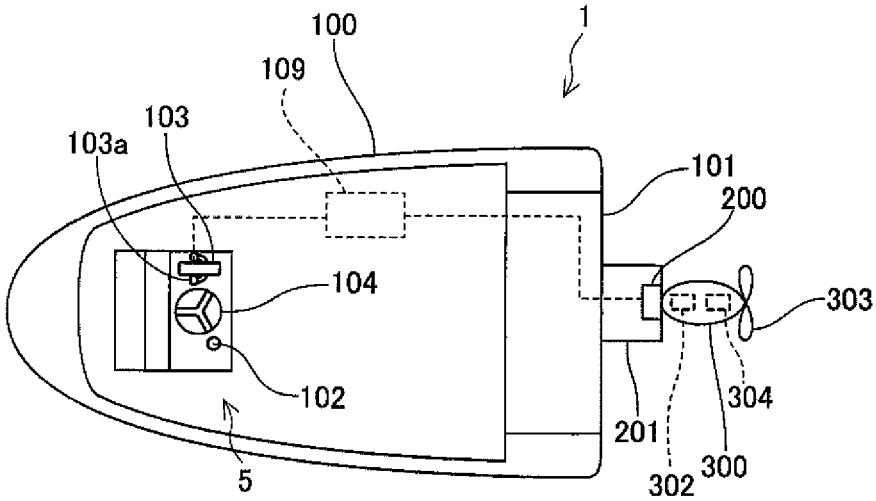
FIG. 2 is a schematic plan view of the marine vessel.
Figure 3:
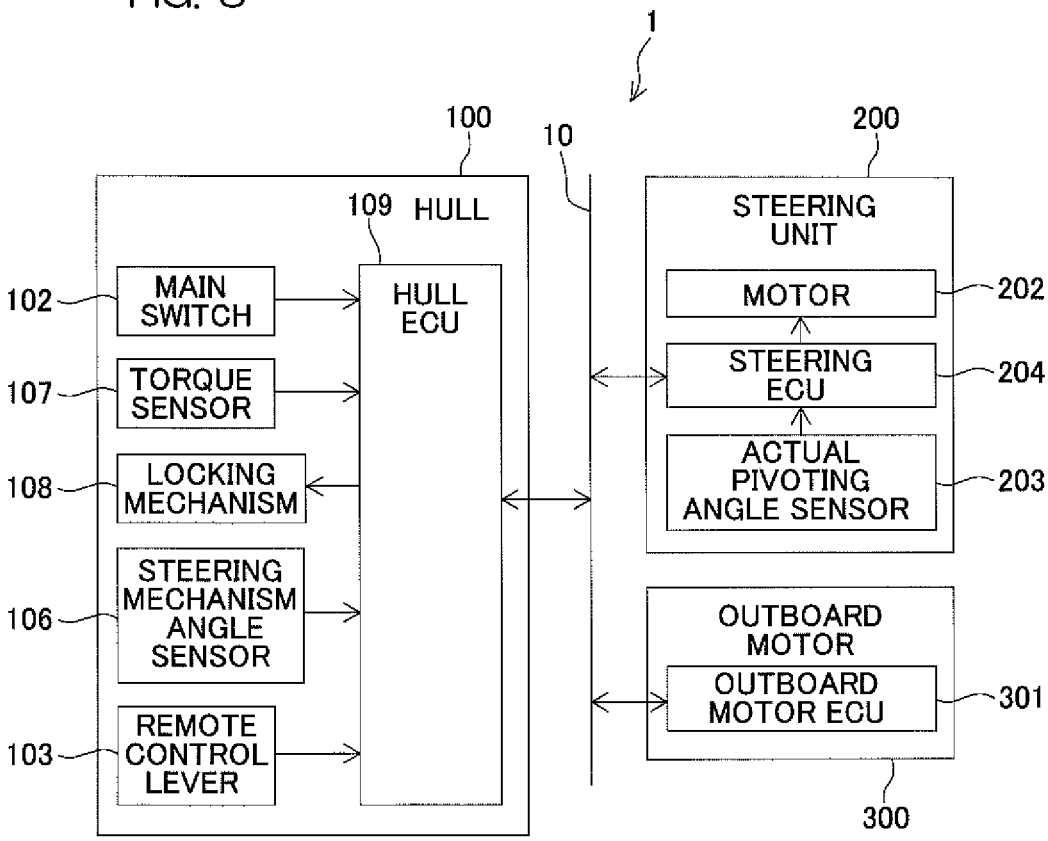
FIG. 3 is a block diagram of the marine vessel steering apparatus.

As shown in FIG. 2, the steering unit 200 is mounted at the stern 101 of the hull 100 via a clamp bracket 201. As shown in FIG. 3, the steering unit 200 includes a motor 202 arranged to turn the outboard motor 300 during steering, an actual pivoting angle sensor 203 (see FIG. 3) arranged to detect the turning angle (actual pivoting angle) of the outboard motor 300, and a steering ECU (electronic control unit) 204. The outboard motor 300 has no rudder and is arranged to steer itself. That is, the steering unit 200 is arranged to change the direction of a propeller 303 by swinging (turning) the main body of the outboard motor 300. This causes the direction of propulsive forces generated by the propeller 303 of the outboard motor 300 to be swung and thereby the heading direction of the hull 100 to be changed. The actual pivoting angle sensor 203 is arranged to be capable of detecting the turning angle (pivoting angle) of the outboard motor 300 as an absolute angle. That is, the actual pivoting angle sensor 203 has a fixed reference point (zero-degree position) and is arranged to detect an angle with respect to the reference point. The motor 202 and the actual pivoting angle sensor 203 are coupled to the steering ECU 204. The steering ECU 204 is arranged to control the motor 202 to make the actual pivoting angle detected by the actual pivoting angle sensor 203 equal to a target pivoting angle. The steering unit 200 is an example of a "steering unit" according to a preferred embodiment of the present invention. The actual pivoting angle sensor 203 is an example of a "first detecting unit" and "pivoting angle sensor" according to a preferred embodiment of the present invention. Also, the outboard motor 300 is an example of a "pivoting unit" according to a preferred embodiment of the present invention.

As shown in FIG. 2, the outboard motor 300 is mounted horizontally pivotally at the stern 101 of the hull 100 via the steering unit 200. The outboard motor 300 includes an outboard motor ECU (electronic control unit) 301 (see FIG. 3), engine 302, propeller 303 to be rotated by a driving force from the engine 302, and a forward-reverse switching mechanism section 304. The forward-reverse switching mechanism section 304 is arranged to be capable of switching between a transmitting state (forward drive or reverse drive) where a driving force is transmitted from the engine 302 to the propeller 303 and a blocking state (neutral state) where a driving force from the engine 302 is blocked off from the propeller 303. The revolution of the engine 302 and the shifting of the forward-reverse switching mechanism section 304 are preferably controlled by the outboard motor ECU 301.

The hull 100 is preferably equipped with a hull ECU (electronic control unit) 109. The hull ECU 109 is an example of a "control unit" according to a preferred embodiment of the present invention together with the steering ECU 204. The hull ECU 109 is arranged and programmed to be capable of communicating information with the steering ECU 204 and the outboard motor ECU 301 via an inboard LAN (local area network) 10 built in the marine vessel 1. Communications are provided also between the steering ECU 204 and the outboard motor ECU 301 via the inboard LAN 10.

The hull ECU 109 preferably includes a microcomputer and is programmed to drive and control the motor 202 in the steering unit 200 and the locking mechanism 108 based on the amount of change in the turning angle (turning amount) detected using the steering mechanism angle sensor 106 and an actual pivoting angle detected by the actual pivoting angle sensor 203. More specifically, the hull ECU 109 receives a signal from the steering mechanism angle sensor 106 and acquires an actual pivoting angle detected by the actual pivoting angle sensor 203 from the steering ECU 204 via the inboard LAN 10. Based on these signals, the hull ECU 109 then computes a target pivoting angle of the outboard motor 300 and transfers the target pivoting angle to the steering ECU 204.

The outboard motor 300 is arranged to be turned by the steering unit 200 within a predetermined angular range ($\theta_0$ degrees (e.g., $\theta_0$=about 30 degrees) at the left and right in the present first preferred embodiment) centering on the straight traveling position (zero-degree position). The amount of steering of the outboard motor 300 is preset correspondingly to the amount of turning of the steering mechanism 104. For example, the hull ECU 109 is programmed, when the steering mechanism 104 is turned two and a half times (e.g., about 900 degrees), to drive the steering unit 200 to turn the outboard motor 300 by about 30 degrees. More specifically, the hull ECU 109 multiplies the turning angle (the amount of change in the operating angle) of the steering mechanism 104 by a certain ratio (pivoting angle ratio) to obtain the amount of change in the target pivoting angle. The hull ECU 109 further adds the amount of change in the target pivoting angle to the original target pivoting angle to obtain a new target pivoting angle. This target pivoting angle is transferred to the steering ECU 204. The steering ECU 204 then drives and controls the motor 202 to make the pivoting angle of the outboard motor 300 equal to the target pivoting angle.

An output signal from the remote control lever unit 103 is acquired by the hull ECU 109. This signal includes directions for switching among neutral, forward drive, and reverse drive and for acceleration control. The hull ECU 109 is programmed to compute a target shift value (forward drive, reverse drive, or neutral) and a target output value (e.g., target engine speed or target throttle opening degree) according to the operation of the remote control lever unit 103. The hull ECU 109 is also programmed to send the target shift value and the target output value to the outboard motor ECU 301 via the inboard LAN 10. The outboard motor ECU 301 is programmed to control the forward-reverse switching mechanism section 304 based on the target shift value and to control the output of the engine 302 (e.g., engine speed or throttle opening degree) based on the target output value.

The hull ECU 109 is programmed to control the locking mechanism 108 based on the turning angle (actual pivoting angle) of the outboard motor 300 detected by the actual pivoting angle sensor 203. That is, the hull ECU 109 is programmed, when the actual pivoting angle of the outboard motor 300 is smaller than the limit angle $\theta_0$ (e.g. $\theta_0$=about 30 degrees), to control the locking mechanism 108 to apply a small resistance to the steering mechanism shaft 105. This causes the steering mechanism 104 to have an appropriate amount of resistance and allows the operator to operate the steering mechanism 104 easily. The hull ECU 109 is also programmed, when the actual pivoting angle of the outboard motor 300 reaches the limit angle $\theta_0$, to control the locking mechanism 108 to lock the steering mechanism 104 by applying a large resistance to the steering mechanism shaft 105. This makes it difficult for the operator to turn the steering mechanism 104, and thus the operator can recognize that the outboard motor 300 is within the limit angle $\theta_0$. The limit angle $\theta_0$ is an example of a "predetermined angle" according to a preferred embodiment of the present invention.

When the steering mechanism 104 is turned in the forward steering direction, the target pivoting angle can reach the limit angle $\theta_0$ before the actual pivoting angle (turning angle of the outboard motor 300) due to a delay in response of the motor 202 in the steering unit 200. For such a case, the hull ECU 109 is programmed to control the locking mechanism 108 so as not to lock the steering mechanism 104. Therefore, even after the target pivoting angle has reached the limit angle $\theta_0$, the operator can turn the steering mechanism 104 in the forward steering direction until the actual pivoting angle reaches the limit angle $\theta_0$.

There may thus be a case where the operator turns the steering mechanism 104 in the forward steering direction after the target pivoting angle has reached the limit angle $\theta_0$. For such a case, the hull ECU 109 is programmed not to make the target pivoting angle greater than the limit angle $\theta_0$ but to keep the target pivoting angle at the limit angle $\theta_0$. In the case where the target pivoting angle is thus kept at the limit angle $\theta_0$, the operator may turn the steering mechanism 104 in the return steering direction. For such a case, the hull ECU 109 is programmed to change the target pivoting angle from the limit angle $\theta_0$ at a certain pivoting angle ratio correspondingly to the turning of the steering mechanism 104 in the return steering direction.

The hull ECU 109 is further programmed, when the actual pivoting angle of the outboard motor 300 reaches the limit angle $\theta_0$ and the steering mechanism 104 is locked, to control the locking mechanism 108 as follows. That is, when the steering mechanism 104 is turned or about to be turned in the direction in which the turning angle of the outboard motor 300 is reduced (i.e., in the return steering direction), the hull ECU 109 controls the locking mechanism 108 to unlock the steering mechanism 104. It is determined, based on, for example, a signal from the torque sensor 107, if the steering mechanism 104 is about to be turned in the return steering direction.

Next will be described the steering control at the time of steering operation of the marine vessel propulsion system (marine vessel steering apparatus) according to the first preferred embodiment of the present invention with reference to FIGS. 5 to 8. It is noted that the control flow in FIG. 5 is preferably repeated by the hull ECU 109 about every 5 msec to about 10 msec, for example.

Figure 5:
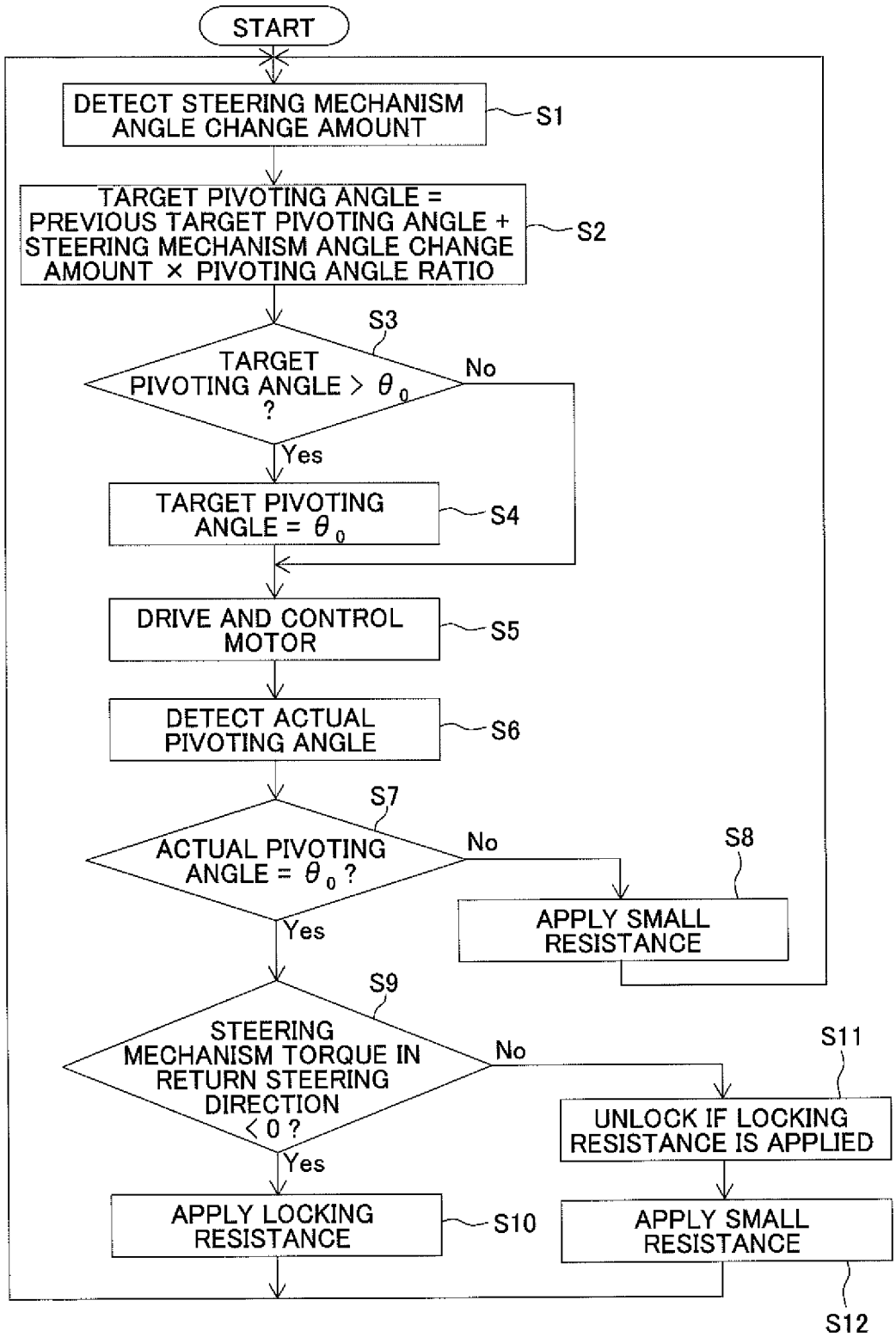
FIG. 5 is a flow chart illustrating the steering control of the marine vessel steering apparatus.

First, in Step S1 in FIG. 5, based on a signal from the steering mechanism angle sensor 106 that is arranged to detect a relative angle, the hull ECU 109 recognizes the amount of change in the turning angle of the steering mechanism 104. That is, the difference in the turning angle of the steering mechanism 104 between at the previous control cycle (about 5 msec to about 10 msec before) and at the current control cycle is detected. In Step S2, the hull ECU 109 obtains a new target pivoting angle using the formula: previous target pivoting angle+steering mechanism angle change amount×pivoting angle ratio.

Next, in Step S3, the hull ECU 109 determines if the obtained target pivoting angle is greater than the limit angle $\theta_0$. If the target pivoting angle is greater than the limit angle $\theta_0$, the hull ECU 109 sets the target pivoting angle to the limit angle $\theta_0$ in Step S4. That is, the hull ECU 109 keeps the target pivoting angle at the limit angle $\theta_0$ independently of the operation of the steering mechanism 104. On the other hand, if the target pivoting angle is equal to or smaller than the limit angle $\theta_0$, the process goes to Step S5 while keeping the target pivoting angle obtained in Step S2.

Next, in Step S5, the hull ECU 109 supplies the target pivoting angle to the steering ECU 204 via the inboard LAN 10. The steering ECU 204 drives and controls the motor 202 in the steering unit 200 to make the actual pivoting angle of the outboard motor 300 detected by the actual pivoting angle sensor 203 equal to the target pivoting angle.

In Step S6, the hull ECU 109 acquires the actual pivoting angle of the outboard motor 300 from the steering ECU 204. Based on a signal from the actual pivoting angle sensor 203 that is arranged to detect the turning angle of the outboard motor 300 as an absolute angle, the steering ECU 204 recognizes the turning angle (actual pivoting angle) of the outboard motor 300 and transfers the actual pivoting angle to the hull ECU 109 via the inboard LAN 10.

Figure 6:
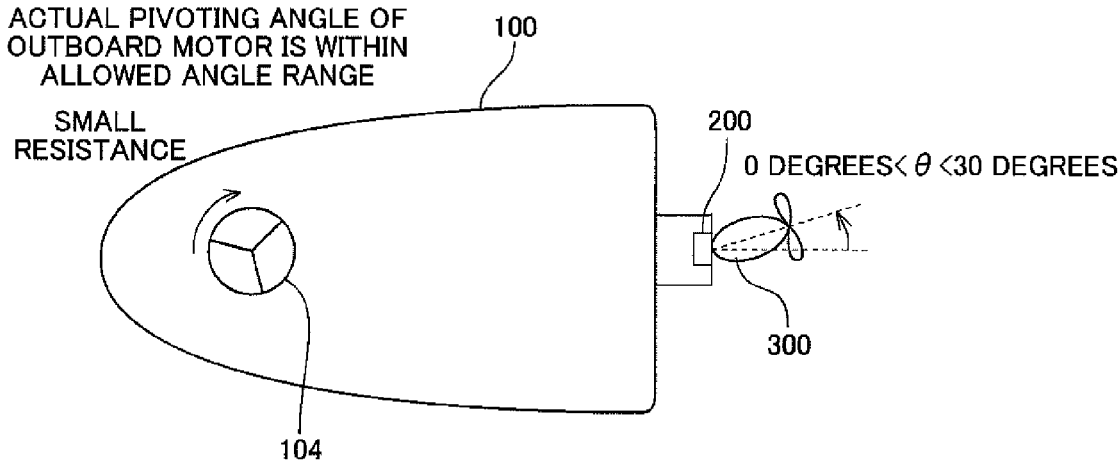
FIGS. 6, 7, and 8 are schematic plan views illustrating the steering control of the marine vessel steering apparatus.

In Step S7, the hull ECU 109 determines if the recognized actual pivoting angle is equal to the limit angle $\theta_0$ (for example, about 30 degrees at the left or right) of the predetermined angular range (for example, about 30 degrees at the left and right centering on the zero-degree position). If the turning angle (actual pivoting angle) of the outboard motor 300 is within the predetermined angular range, the locking mechanism 108 applies a small resistance to the steering mechanism shaft 105 in Step S8. That is, the hull ECU 109 controls the locking mechanism 108 to apply a small current to the coil 108*c* in the locking mechanism 108 and thereby make the viscosity of the magnetic fluid 108*b* a little higher than in the case of not being energized. In this state, the operator can turn the steering mechanism 104 easily as shown in FIG. 6.

Figure 7:
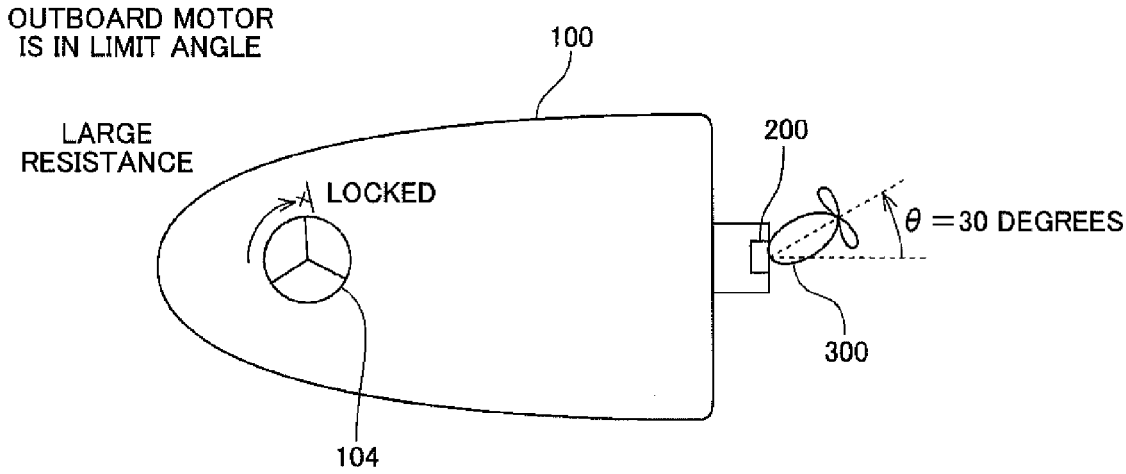

If the turning angle (actual pivoting angle) of the outboard motor 300 is equal to the limit angle $\theta_0$ of the predetermined angular range, the hull ECU 109 determines, based on a signal from the torque sensor 107, if the torque in the return steering direction is negative (smaller than zero) in Step S9. If the torque in the return steering direction is negative, the steering mechanism 104 is about to be turned in the forward steering direction. In this case, the locking mechanism 108 applies a large resistance (locking resistance) to the steering mechanism shaft 105 in Step S10 to lock the steering mechanism 104. That is, the hull ECU 109 controls the locking mechanism 108 to apply a large current to the coil 108*c* in the locking mechanism 108 and thereby make the viscosity of the magnetic fluid 108*b* much higher than in the case of not being energized. As shown in FIG. 7, when the steering mechanism 104 is locked, the operator cannot turn the steering mechanism 104 easily.

Figure 8:
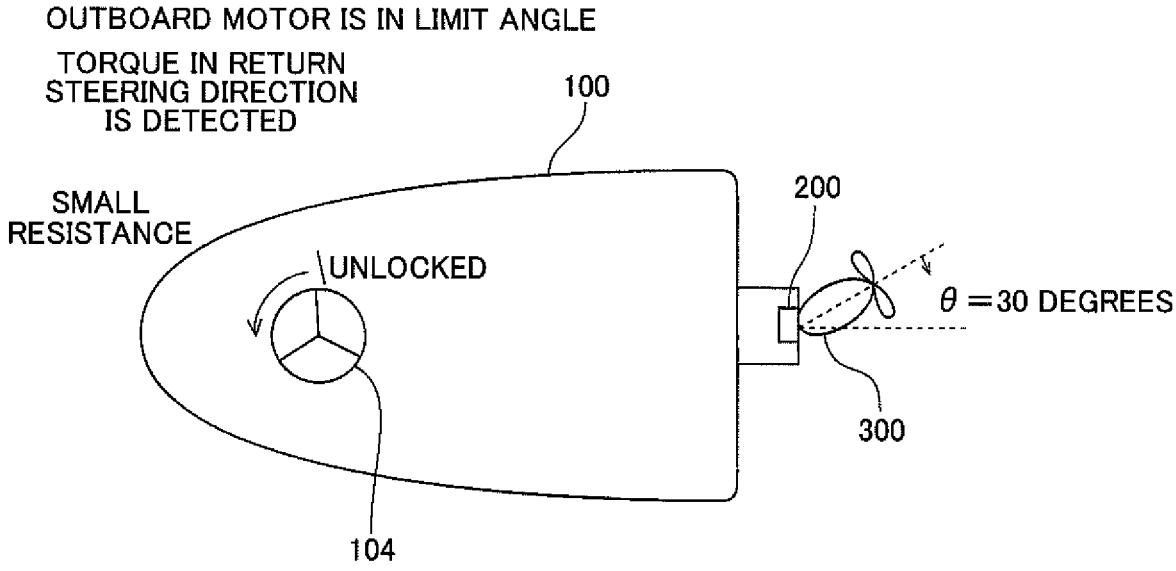

If the torque in the return steering direction is zero or positive (greater than zero), the steering mechanism 104 is (about to be) turned in the return steering direction or the steering mechanism operation is stopped. In this case, the hull ECU 109 controls the locking mechanism 108 to unlock the steering mechanism 104, if locked, in Step S11 and then apply a small resistance to the steering mechanism shaft 105 in Step S12. This causes the steering mechanism 104 to be unlocked to be rotatably operable as shown in FIG. 8. If the steering mechanism 104 is not locked, the hull ECU 109 continues to control the locking mechanism 108 so as to apply a small resistance directly to the steering mechanism shaft 105.

Next will be described exemplary steering operations of the marine vessel propulsion system according to the first preferred embodiment of the present invention with reference to FIGS. 9 and 10.

Figure 9:
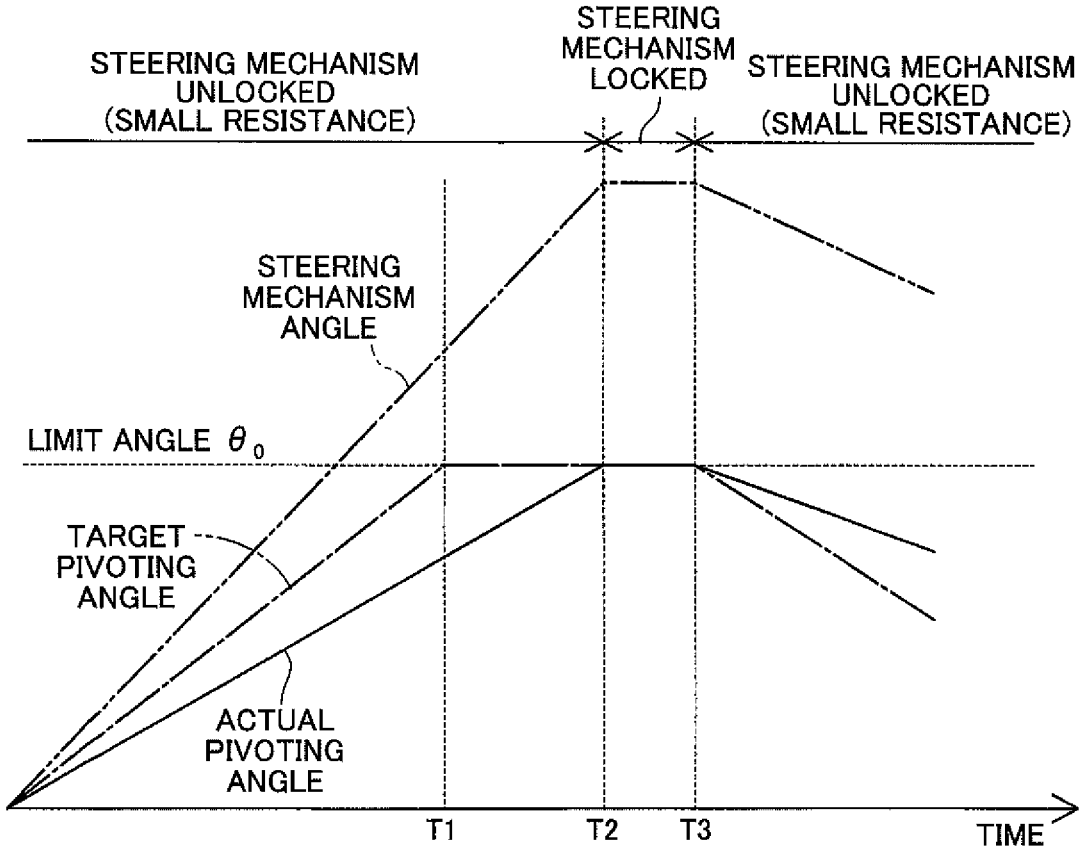
FIG. 9 is a timing chart illustrating an exemplary steering operation (in which the pivoting unit is returned after the steering mechanism is locked).

FIG. 9 shows an exemplary operation in the case where the steering mechanism 104 starts to be returned after the actual pivoting angle has reached the limit angle $\theta_0$. While the operator turns the steering mechanism 104 in one direction, the target pivoting angle increases in proportion to the steering mechanism angle. The actual pivoting angle also increases after the target pivoting angle. At time T1, the target pivoting angle reaches the limit angle $\theta_0$ before the actual pivoting angle. At this time, since the actual pivoting angle has not reached the limit angle $\theta_0$, the steering mechanism 104 is not locked. Therefore, the steering mechanism 104 can be turned in the forward steering direction.

After time T1, although the turning angle of the steering mechanism 104 continues to increase, the target pivoting angle is kept at the limit angle $\theta_0$. The actual pivoting angle increases to be equal to the target pivoting angle kept at the limit angle $\theta_0$ and, at time T2, reaches the limit angle $\theta_0$. When the actual pivoting angle reaches the limit angle $\theta_0$, the turning of the steering mechanism 104 is locked. This allows the operator to recognize that the turning angle (actual pivoting angle) of the outboard motor 300 reaches the limit angle $\theta_0$.

At time T3, when the operator tries to turn the steering mechanism 104 in the return steering direction, the steering mechanism 104 is unlocked. This allows the operator to perform return steering easily. When the steering mechanism 104 starts to be turned in the return steering direction at time T3, the target pivoting angle also starts to decrease from the limit angle $\theta_0$ with the turning of the steering mechanism 104 at time T3.

Figure 10:
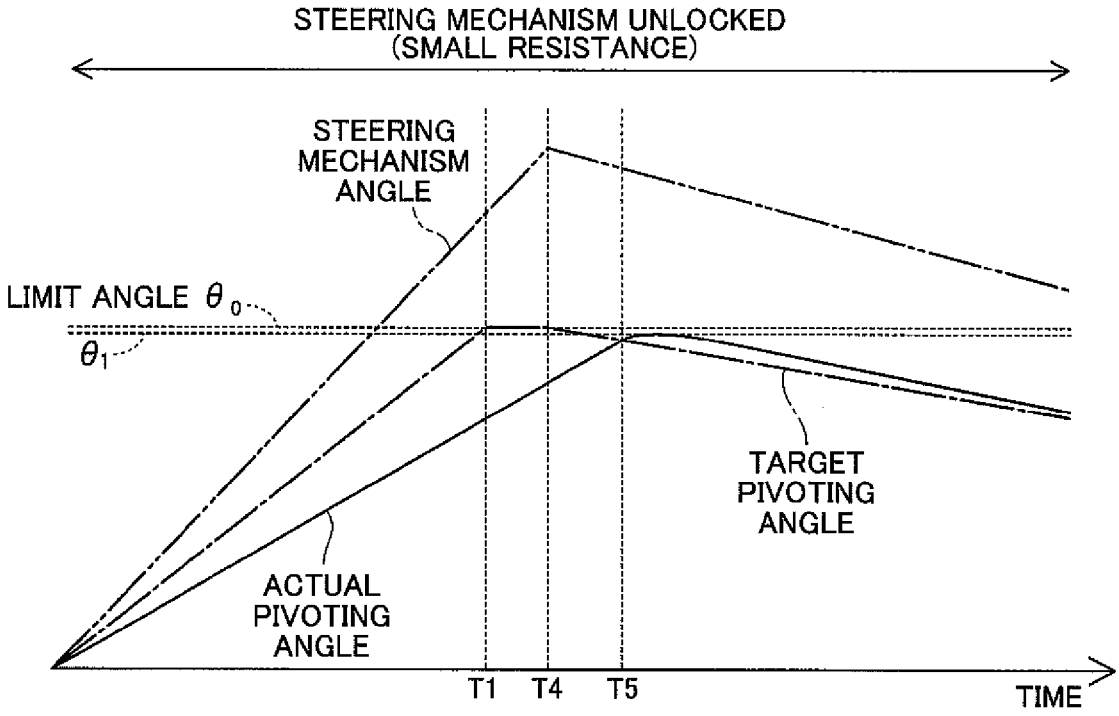
FIG. 10 is a timing chart illustrating another exemplary steering operation (in which the pivoting unit is returned before the steering mechanism is locked).

FIG. 10 shows an exemplary operation in the case where the steering mechanism 104 starts to be returned before the actual pivoting angle reaches the limit angle $\theta_0$. The operations until time T1 are the same as those in the exemplary operation shown in FIG. 9. After time T1, although the turning angle of the steering mechanism 104 increases, the target pivoting angle is kept at the limit angle $\theta_0$. The actual pivoting angle increases to the target pivoting angle kept at the limit angle $\theta_0$.

At time T4, the operator starts to return the steering mechanism 104. In this case, when the steering mechanism 104 starts to be turned in the return steering direction at time T4, the target pivoting angle also starts to decrease from the limit angle $\theta_0$ accordingly at time T4.

After time T4, the steering mechanism 104 is turned in the return steering direction. However, since the target pivoting angle is greater than the actual pivoting angle, the actual pivoting angle increases to the target pivoting angle. At time T5, the target pivoting angle becomes equal to the actual pivoting angle. After time T5, the actual pivoting angle decreases after the target pivoting angle. Immediately after time T5, the actual pivoting angle increases to an angle $\theta_1$. This is due to the inertial force of the outboard motor 300.

In the present first preferred embodiment, when the actual pivoting angle sensor 203 detects that the actual pivoting angle of the outboard motor 300 has reached the limit angle $\theta_0$, the locking mechanism 180 locks the turning of the steering mechanism 104 in the forward steering direction, as mentioned above. Therefore, even if there may occur a delay in the turning of the outboard motor 300 with respect to the operation of the steering mechanism 104, the steering mechanism 104 is locked at the time the actual pivoting angle of the outboard motor 300 reaches the limit angle $\theta_0$. This allows the operator to correctly recognize that the turning angle of the outboard motor 300 has reached the limit angle $\theta_0$ because the steering mechanism 104 is locked. This also allows the operator to turn the outboard motor 300 reliably to the limit angle $\theta_0$, which can prevent the turning performance of the marine vessel from being reduced.

Also, in the first preferred embodiment, even if the target pivoting angle may reach the limit angle $\theta_0$ before the actual pivoting angle of the outboard motor 300 reaches the limit angle $\theta_0$, the locking mechanism 108 does not lock the turning of the steering mechanism 104 until it is detected that the actual pivoting angle of the outboard motor 300 has reached the limit angle $\theta_0$, as mentioned above. This can reliably prevent the steering mechanism 104 from being locked before the actual pivoting angle of the outboard motor 300 has reached the limit angle $\theta_0$.

Further, in the present first preferred embodiment, if the target pivoting angle reaches the limit angle $\theta_0$ before the actual pivoting angle of the outboard motor 300 reaches the limit angle $\theta_0$, the target pivoting angle is kept at the limit angle $\theta_0$ even if the steering mechanism 104 may be turned in the forward steering direction. Then, when the steering mechanism 104 is turned in the return steering direction, the target pivoting angle accordingly changes from the limit angle $\theta_0$. Thus, when the operator turns the steering mechanism 104 in the return steering direction, the pivoting angle of the outboard motor 300 can be returned according to the operation of the steering mechanism 104 after the steering mechanism 104 starts to be returned. This can prevent a delay in response of the pivoting with respect to the operation of the steering mechanism 104 when the pivoting unit starts to be returned.

Also, in the present first preferred embodiment, the locking mechanism 108 is arranged to apply a current to the coil 108*c* to change the viscosity of the magnetic fluid 108*b*, as mentioned above. This allows the turning of the steering mechanism 104 to be locked by applying a resistance to the turning of the steering mechanism 104 both in the forward steering direction and the return steering direction. This arrangement allows the structure of the locking mechanism 108 to be simplified and the power consumption when locking the steering mechanism 104 to be reduced.

Furthermore, in the first preferred embodiment, the torque sensor 107 is arranged to detect if the steering mechanism 104 is turned in the return steering direction or the steering mechanism 104 is about to be turned in the return steering direction when the actual pivoting angle of the outboard motor 300 has reached the limit angle $\theta_0$, as mentioned above. The turning of the steering mechanism 104 locked by the locking mechanism 108 is unlocked based on detection information from the torque sensor 107. With this arrangement, when the operator turns the steering mechanism 104 in the return steering direction, the steering mechanism 104 locked by the locking mechanism 108 can be unlocked. This can prevent the steering mechanism 104 from becoming non-returnable (non-turnable in the return steering direction) once locked.

Moreover, in the present first preferred embodiment, the actual pivoting angle of the outboard motor 300 is detected by the actual pivoting angle sensor 203 as an absolute angle, while the amount of turning of the steering mechanism 104 is detected by the steering mechanism angle sensor 106 as a relative angle, as mentioned above. Since the steering mechanism angle sensor 106 is arranged to detect a relative angle, there maybe a case where it is difficult to recognize the absolute turning angle of the steering mechanism 104. This has no impact on the steering mechanism locking control. That is, since the actual pivoting angle sensor 203 can recognize the absolute turning angle of the outboard motor 300, the steering mechanism 104 can be locked at the right time based on detection information from the actual pivoting angle sensor 203.

Second Preferred Embodiment

Next will be described a marine vessel propulsion system (marine vessel steering apparatus) according to a second preferred embodiment of the present invention. In the present second preferred embodiment, when the steering mechanism 104 is turned in the return steering direction, the target pivoting angle decreases from the actual pivoting angle at the time the steering mechanism 104 starts to be returned.

The structure of the marine vessel propulsion system according to the second preferred embodiment of the present invention will first be described with reference to FIGS. 3 and 11.

Figure 11:
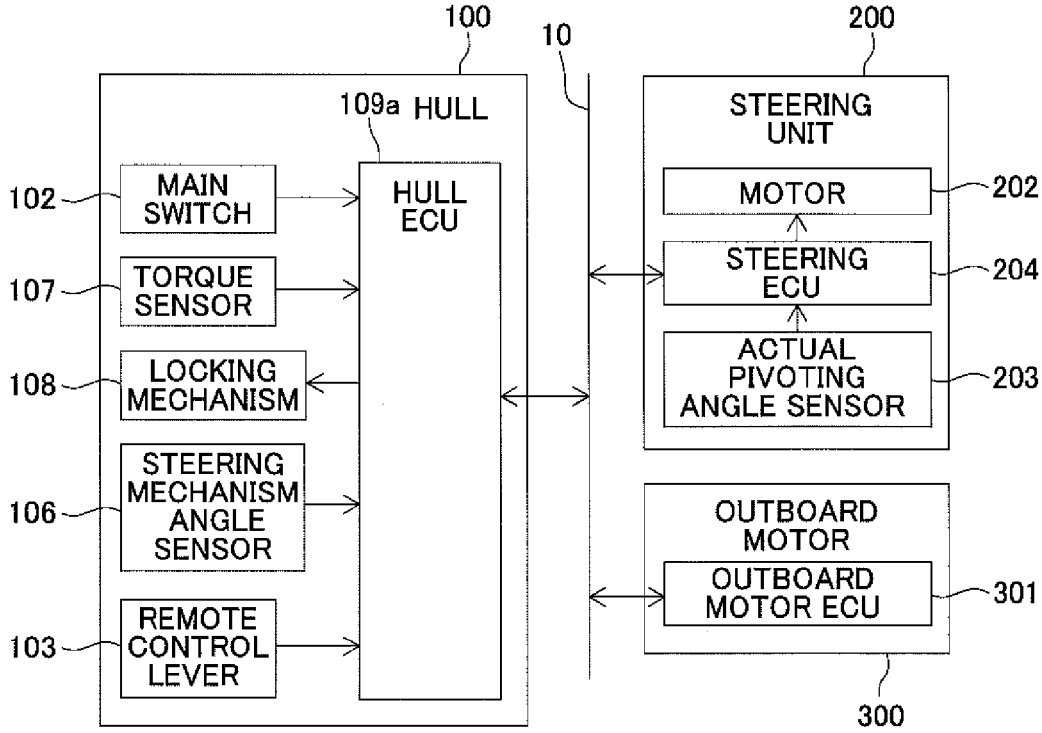
FIG. 11 is a block diagram showing the electrical configuration of a marine vessel including a marine vessel steering apparatus according to a second preferred embodiment of the present invention.

As shown in FIG. 11, the marine vessel propulsion system according to the second preferred embodiment has a structure in which the hull ECU 109 according to the above-described first preferred embodiment shown in FIG. 3 is replaced with a hull ECU 109*a*. The hull ECU 109*a* is an example of a "control unit" according to a preferred embodiment of the present invention. The hull ECU 109*a* is programmed, even if the target pivoting angle may reach the limit angle $\theta_0$ before the actual pivoting angle (turning angle of the outboard motor 300), to control the locking mechanism 108 so as not to lock the steering mechanism 104 until the actual pivoting angle reaches the limit angle $\theta_0$. The hull ECU 109*a* is also programmed, when the operator turns the steering mechanism 104 in the forward steering direction after the target pivoting angle has reached the limit angle $\theta_0$, not to make the target pivoting angle greater than the limit angle $\theta_0$ but to keep at the limit angle $\theta_0$.

In the present second preferred embodiment, the hull ECU 109*a* is programmed, when the steering mechanism 104 is turned in the return steering direction, to operate as follows, unlike the above-described first preferred embodiment. That is, the hull ECU 109*a* obtains the actual pivoting angle at the time the steering mechanism 104 starts to be turned in the return steering direction (return steering start angle). The hull ECU 109*a* then changes the target pivoting angle to the return steering start angle. The hull ECU 109*a* further changes the target pivoting angle from the return steering start angle at a pivoting angle ratio correspondingly to the turning of the steering mechanism 104 in the return steering direction.

Other components other than the hull ECU 109*a* are preferably the same as those in the above-described first preferred embodiment.

Next will be described the steering control at the time of steering operation of the marine vessel propulsion system according to the second preferred embodiment of the present invention with reference to FIG. 12.

Figure 12:
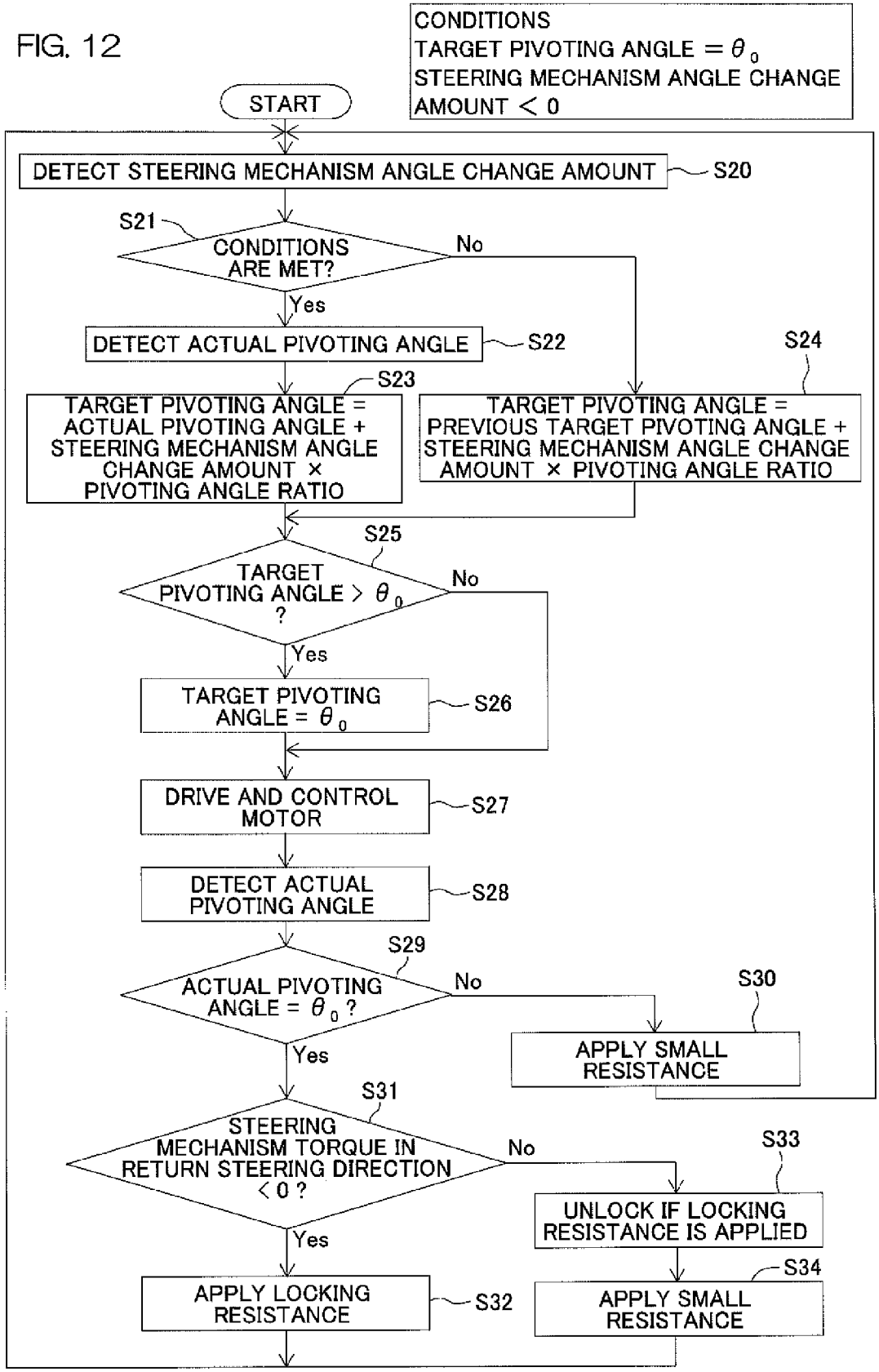
FIG. 12 is a flow chart illustrating the steering control of the marine vessel steering apparatus according to the second preferred embodiment of the present invention.

First, in Step S20 in FIG. 12, based on a signal from the steering mechanism angle sensor 106 that is arranged to detect a relative angle, the hull ECU 109*a* recognizes the amount of change in the turning angle (amount of turning) of the steering mechanism 104.

In the present second preferred embodiment, the hull ECU 109*a* determines if predetermined conditions are met in the next Step S21. These conditions include "target pivoting angle=limit angle $\theta_0$" and "steering mechanism angle change amount<0, where the forward steering direction is positive." That is, in the state where the steering mechanism 104 is turned further than the turning angle at which the target pivoting angle reaches the limit angle $\theta_0$, it is determined if the steering mechanism 104 starts to be turned in the return steering direction.

If the conditions are met, the hull ECU 109*a* acquires the actual pivoting angle in Step S22. Further, in Step S23, the hull ECU 109*a* sets the target pivoting angle to "actual pivoting angle+steering mechanism angle change amount×pivoting angle ratio." That is, if the target pivoting angle is different from the actual pivoting angle due to, for example, a delay in response of the motor 202, the hull ECU 109*a* replaces the target pivoting angle with the actual pivoting angle at the time the steering mechanism 104 starts to be returned.

On the other hand, if the conditions are not met, the hull ECU 109*a* sets the target pivoting angle to "previous target pivoting angle+steering mechanism angle change amount× pivoting angle ratio" in Step S24. The cases where the conditions are not met include the case where the target pivoting angle is smaller than the limit angle $\theta_0$ (target pivoting angle<limit angle $\theta_0$), the case where the steering mechanism 104 is not turned (steering mechanism angle change amount=0), and the case where the steering mechanism 104 is turned in the forward steering direction (steering mechanism angle change amount>0). In these cases, the current target pivoting angle is obtained based on the previous target pivoting angle.

The following Steps S25 to S34 undergo the same processing as Steps S3 to S12 in the above-described first preferred embodiment.

Figure 13:
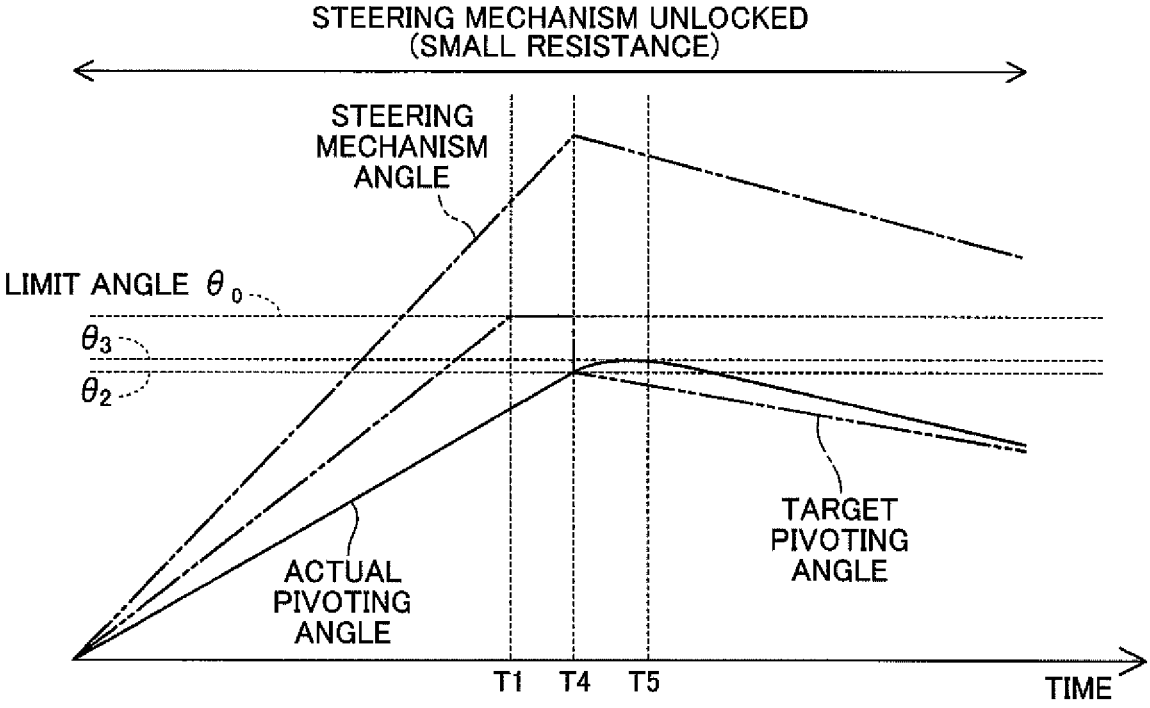
FIG. 13 is a timing chart illustrating an exemplary steering operation (in which the pivoting unit is returned before the steering mechanism is locked).

Next will be described an exemplary steering operation of the marine vessel propulsion system according to the second preferred embodiment of the present invention with reference to FIGS. 5, 9, 10, 12, and 13. FIG. 13 shows an exemplary operation in the case where the steering mechanism 104 starts to be returned before the actual pivoting angle reaches the limit angle $\theta_0$. The times T1, T4, and T5 in FIG. 13 represent the same timing, respectively, as the times T1, T4, and T5 in FIG. 10.

In the present second preferred embodiment, the steering operation in the case where the steering mechanism 104 starts to be returned after the actual pivoting angle has reached the limit angle $\theta_0$ is the same as that in the above-described first preferred embodiment shown in FIG. 9. That is, the actual pivoting angle has reached the limit angle $\theta_0$ at the time the steering mechanism 104 starts to be returned (at time T3), at which actual pivoting angle=target pivoting angle=limit angle $\theta_0$. Therefore, the target pivoting angle obtained in Step S23 in FIG. 12 is equal to the target pivoting angle obtained in Step S24 (corresponding to the target pivoting angle obtained in Step S2 in FIG. 5). For this reason, if the steering mechanism 104 is turned in the same manner, the change in the actual pivoting angle in the present second preferred embodiment is the same as that in the above-described first preferred embodiment.

On the other hand, the steering operation in the case where the steering mechanism 104 starts to be returned before the actual pivoting angle reaches the limit angle $\theta_0$ is as shown in FIG. 13, for example. The operations until time T1 are the same as those shown in FIG. 9. After time T1, although the turning angle of the steering mechanism 104 increases, the target pivoting angle is kept at the limit angle $\theta_0$. The actual pivoting angle increases to the target pivoting angle kept at the limit angle $\theta_0$. In the exemplary operation shown in FIG. 13, the operator starts to return the steering mechanism 104 at time T4. In this case, since the conditions in Step S21 in FIG. 12 are met at time T4, the target pivoting angle is replaced with the actual pivoting angle in Step S23. This causes the target pivoting angle to be changed to the actual pivoting angle not reaching the limit angle $\theta_0$ (return steering start angle $\theta_2$) at time T4. With the turning of the steering mechanism 104 in the return steering direction, the target pivoting angle also starts to decrease from the return steering start angle $\theta_2$ at time T4. As the target pivoting angle decreases, the actual pivoting angle also decreases after the target pivoting angle. It is noted that immediately after time T4, the actual pivoting angle increases. This is due to the inertial force of the outboard motor 300.

In the above-described first preferred embodiment, when the steering mechanism 104 starts to be returned at time T4 as is the case in the second preferred embodiment, the actual pivoting angle increases to the angle $\theta_1$ (see FIG. 10) and then decreases. On the other hand, in the second preferred embodiment, when the steering mechanism 104 starts to be returned at time T4, the actual pivoting angle increases to an angle $\theta_3$ (see FIG. 13), which is smaller than the angle $\theta_1$, and then decreases. That is, in the second preferred embodiment, the response speed of the actual pivoting angle with respect to the operation of the steering mechanism 104 is higher than in the above-described first preferred embodiment.

In the second preferred embodiment, when the steering mechanism 104 is operated in the return steering direction after the target pivoting angle has reached the limit angle $\theta_0$, the target pivoting angle is replaced with the return steering start angle $\theta_2$, the actual pivoting angle of the outboard motor 300 at the start of the operation, as mentioned above. Further, the target pivoting angle is changed from the return steering start angle $\theta_2$ correspondingly to the turning of the steering mechanism 104 in the return steering direction. With this arrangement, even in the case where the steering mechanism 104 is turned further than the angle that corresponds to the limit angle $\theta_0$, when the steering mechanism 104 is turned in the return steering direction, the pivoting angle of the outboard motor 300 can be returned according to the operation of the steering mechanism 104 after the start of the turning. This can prevent a delay in response of the pivoting angle with respect to the operation of the steering mechanism 104 when the operator intends to start to return thepivoting unit. The same applies to the case where the steering mechanism 104 is turned slightly and the target pivoting angle does not reach the limit angle $\theta_0$. That is, when the steering mechanism 104 is turned in the return steering direction, the pivoting angle of the outboard motor 300 can be returned according to the operation of the steering mechanism 104 after the steering mechanism 104 starts to be returned.

Other Preferred Embodiments

The above-disclosed preferred embodiments are to be considered in all aspects only as illustrative and not restrictive. The scope of the present invention is not defined by the above-described preferred embodiments, but rather by the claims appended hereto. Further, the present invention includes all the modifications within the meaning and scope equivalent to those defined by the appended claims.

For example, although the first and second preferred embodiments above describe the case where the present invention is preferably applied to the arrangement in which the outboard motor 300 is turned for steering, the present invention is not restricted thereto. That is, the present invention may be applied to arrangements in which a drive unit is turned for steering, such as propulsion systems adopting inboard and outboard motors. Such a drive unit includes a pivoting unit and a propeller. The present invention may also be applied to arrangements in which a pivoting unit provided separately from a propeller is turned, such as propulsion systems adopting an inboard motor.

Although, the first and second preferred embodiments above describe the case where the steering mechanism angle sensor 106 is preferably used to detect the relative amount of rotation of the steering mechanism shaft 105, the present invention is not restricted thereto. That is, a steering mechanism angle sensor arranged to detect the absolute amount of rotation of the steering mechanism shaft 105 may be used.

Although, the first and second preferred embodiments above describe the case where the turning of the steering mechanism 104 is preferably locked by the locking mechanism 108 that uses magnetic fluid 108*b* to apply a resistance to the rotation of the steering mechanism shaft 105, the present invention is not restricted thereto. That is, the locking mechanism includes any type of mechanism that can switch or adjust the magnitude of resistance against the steering mechanism 104. Alternatively, locking mechanisms that can lock the steering mechanism 104 in a specified turning direction may be used. Such locking mechanisms include reactive motors that apply an operational reactive force to the steering mechanism shaft 105. Such reactive motors may be to be controlled by the hull ECU 109 or 109*a* such that a reactive torque is applied to the steering mechanism shaft 105 in the direction opposite to that of an operational torque applied on the steering mechanism shaft 105.

Examples of such locking mechanisms further include clutch mechanisms. Clutch mechanisms may include a clutch plate coupled to the steering mechanism, another clutch plate fixed to a housing or the like, and an actuator arranged to switch or adjust the engagement between these plates. With this arrangement, the steering mechanism can be locked by utilizing resistance between the clutch plates.

Also, in the first and second preferred embodiments above, the steering unit 200, which is preferably arranged to turn the outboard motor 300 with a driving force from the motor 202, is preferably shown as an example of a "steering unit" according to a preferred embodiment of the present invention, but the present invention is not restricted thereto. The steering unit may include other mechanisms that are arranged to turn the outboard motor 300 (pivoting section) through electrical drive control. For example, a hydraulic steering unit arranged to hydraulically turn the outboard motor 300 may be used.

Such a hydraulic steering unit may include, for example, an electric pump to be driven according to the turning of the steering mechanism and a hydraulic cylinder connected to the suction and discharge ports of the electric pump via an oil passage. With the turning of the steering mechanism, oil flows through the electric pump and the oil passage to activate the hydraulic cylinder and thereby turn the outboard motor 300.

In the case above, the locking mechanism may include an actuator arranged to switch between open and close of the oil passage. When the oil passage is closed, oil does not flow with the turning of the steering mechanism, which makes it possible to apply a large turning resistance to the steering mechanism. This causes the steering mechanism to be locked.

Although the first and second preferred embodiments above describe the case where the steering mechanism 104 is preferably locked when the actual pivoting angle of the outboard motor 300 becomes equal to or greater than the limit angle $\theta_0$, the present invention is not restricted thereto. For example, an angle smaller than the limit angle may be preset as a predetermined angle and the steering mechanism may be locked when the turning angle of the outboard motor becomes equal to or greater than the predetermined angle. For example, the angular range of turning of the outboard motor may be pre-designed more widely (e.g., $0 \leqq \theta \leqq 45$ degrees (limit angle)) than normal ($0 \leqq \theta \leqq 30$ degrees in the first and second preferred embodiments). In this case, during the normal marine vessel maneuvering, the steering mechanism may be locked when the turning angle of the outboard motor becomes equal to or greater than about 30 degrees (predetermined angle), for example. Then, for higher turning performance of the marine vessel (e.g. for the case of launching from and docking on shore), the steering mechanism may not be locked even when the turning angle of the outboard motor may become equal to or greater than about 30 degrees, but may be locked when the turning angle of the outboard motor reaches about 45 degrees (limit angle), for example.

Although, the above-described preferred embodiments describe the case of a marine vessel including one outboard motor, the present invention may be applied to marine vessels including two or more outboard motors. For example, the steering mechanism may be locked when the actual pivoting angle of one of the multiple outboard motors becomes equal to or greater than a predetermined angle (e.g., limit angle).

While preferred embodiments of the present invention have been described above, it is to be understood that variations and modifications will be apparent to those skilled in the art without departing the scope and spirit of the present invention. The scope of the present invention, therefore, is to be determined solely by the following claims.

The present application corresponds to Japanese Patent Application No. 2009-086404 filed in the Japan Patent Office on Mar. 31, 2009, and the entire disclosure of the application is incorporated herein by reference.

What is claimed is:

1. A marine vessel steering apparatus comprising:

a steering mechanism arranged to be operable by an operator;

a steering unit arranged to turn a pivoting unit to be mounted pivotally on a marine vessel;

a first detecting unit arranged to detect if an actual pivoting angle becomes equal to or greater than a predetermined angle;

a locking unit arranged to lock a turning of the steering mechanism; and a control unit programmed to set a target pivoting angle based on a turning state of the steering mechanism and to drive the steering unit to make the actual pivoting angle equal to the target pivoting angle, and, when the first detecting unit detects that the actual pivoting angle becomes equal to or greater than the predetermined angle, to drive the locking unit to lock the turning of the steering mechanism.

2. The marine vessel steering apparatus according to claim 1, wherein the control unit is programmed to control the locking unit so as not to lock the turning of the steering mechanism irrespective of the turning angle of the steering mechanism or the target pivoting angle until it is detected that the actual pivoting angle becomes equal to or greater than the predetermined angle.

3. The marine vessel steering apparatus according to claim 2, wherein in a case where the target pivoting angle becomes equal to or greater than the predetermined angle before the actual pivoting angle becomes equal to or greater than the predetermined angle, the control unit is programmed to keep the target pivoting angle at the predetermined angle when the steering mechanism is turned in a forward steering direction, and when the steering mechanism is turned in a return steering direction, to change the target pivoting angle from the predetermined angle correspondingly to the turning of the steering mechanism in the return steering direction.

4. The marine vessel steering apparatus according to claim 2, wherein in a case where the target pivoting angle becomes equal to or greater than the predetermined angle before the actual pivoting angle becomes equal to or greater than the predetermined angle, the control unit is programmed to replace the target pivoting angle with a return steering start angle which is the actual pivoting angle at a time the steering mechanism starts to be turned in the return steering direction when the steering mechanism is turned in a return steering direction, and to change the target pivoting angle from the return steering start angle correspondingly to the turning of the steering mechanism in the return steering direction.

5. The marine vessel steering apparatus according to claim 1, wherein the locking unit is arranged to lock the turning of the steering mechanism by applying a resistance against a left and right turning of the steering mechanism;

the marine vessel steering apparatus further comprising a second detecting unit arranged, when the actual pivoting angle becomes equal to or greater than the predetermined angle, to detect if the steering mechanism is turned in a return steering direction or the steering mechanism is about to be turned in the return steering direction; and the control unit is programmed to unlock the turning of the steering mechanism locked by the locking unit based on detection information from the second detecting unit.

6. The marine vessel steering apparatus according to claim 5, wherein the locking unit includes magnetic fluid and a magnetic field generating portion and is arranged to apply a resistance against the left and right turning of the steering mechanism when the magnetic field generating portion is applied with a current to change a viscosity of the magnetic fluid.

7. The marine vessel steering apparatus according to claim 1, wherein the first detecting unit includes a pivoting angle sensor arranged to detect the turning angle of the pivoting unit as an absolute angle, the marine vessel steering apparatus further comprising a steering mechanism angle detecting unit arranged to detect an amount of change in the turning angle of the steering mechanism as a relative angle.

8. The marine vessel steering apparatus according to claim 1, wherein the pivoting unit is an outboard motor arranged to be pivotally mounted on a hull within a predetermined angular range in response to the turning of the steering mechanism.

9. A marine vessel comprising:

a hull;

a pivoting unit mounted pivotally on the hull; and the marine vessel steering apparatus according to claim 1.

10. The marine vessel steering apparatus according to claim 1, wherein the control unit controls the locking unit to lock the turning of the steering mechanism or to unlock the turning of the steering mechanism.

11. The marine vessel steering apparatus according to claim 1, wherein the locking unit is arranged to lock the turning of the steering mechanism by applying a resistance against the turning of the steering mechanism; and the control unit is programmed to unlock the locking unit by applying a resistance, which is smaller than the resistance that locks the turning of the steering mechanism, when the first detecting unit detects that the actual pivoting angle is less than the predetermined angle.

12. The marine vessel steering apparatus according to claim 1, wherein there is a delay in the pivoting of the pivoting unit with respect to the turning of the steering mechanism.

13. The marine vessel steering apparatus according to claim 1, wherein the steering mechanism is arranged to be turnable any number of times when a marine vessel propulsion system is powered off.

* * * * *